US010497299B2

(12) United States Patent
Peana et al.

(10) Patent No.: US 10,497,299 B2
(45) Date of Patent: Dec. 3, 2019

(54) INFORMATION HANDLING SYSTEM DISPLAY INTELLIGENT CONTROL RESPONSE TIME

(71) Applicant: Dell Products L.P., Round Rock, TX (US)

(72) Inventors: Stefan Peana, Austin, TX (US); Chung-Jen Chen, Taipei (TW); Kenneth W. Stufflebeam, Georgetown, TX (US)

(73) Assignee: Dell Products L.P., Round Rock, TX (US)

( * ) Notice: Subject to any disclaimer, the term of this patent is extended or adjusted under 35 U.S.C. 154(b) by 146 days.

(21) Appl. No.: 15/703,214

(22) Filed: Sep. 13, 2017

(65) Prior Publication Data

US 2019/0080639 A1 Mar. 14, 2019

(51) Int. Cl.
*G09G 3/36* (2006.01)
*G09G 3/20* (2006.01)

(52) U.S. Cl.
CPC ..... *G09G 3/2003* (2013.01); *G09G 3/2096* (2013.01); *G09G 3/36* (2013.01); *G09G 3/3648* (2013.01); *G09G 2310/08* (2013.01); *G09G 2320/0252* (2013.01); *G09G 2320/0606* (2013.01); *G09G 2320/0626* (2013.01); *G09G 2330/022* (2013.01); *G09G 2330/023* (2013.01); *G09G 2354/00* (2013.01); *G09G 2360/144* (2013.01); *G09G 2370/02* (2013.01)

(58) Field of Classification Search
CPC ..... G09G 2320/0252
See application file for complete search history.

(56) References Cited

U.S. PATENT DOCUMENTS

| | | | | |
|---|---|---|---|---|
| 7,428,647 | B2 | 9/2008 | Price et al. | |
| 2007/0222726 | A1* | 9/2007 | Chen | G09G 3/3611 345/87 |
| 2008/0284719 | A1* | 11/2008 | Yoshida | G02F 1/136277 345/102 |
| 2009/0091524 | A1* | 4/2009 | Lomas | G09G 3/3611 345/87 |
| 2012/0098876 | A1* | 4/2012 | Murai | G09G 3/3406 345/690 |
| 2016/0275850 | A1* | 9/2016 | Zheng | G09G 3/32 |

* cited by examiner

*Primary Examiner* — Sanghyuk Park
(74) *Attorney, Agent, or Firm* — Zagorin Cave LLP; Robert W. Holland

(57) ABSTRACT

A display presents information with pixels driven at overdrive voltages set based upon a user configuration and sensed environmental conditions. Varied overdrive voltages provide adaptable display responses with proportional power consumption so that power consumption is reduced where visual images of a display content have reduced need for rapid display response. For example, reduced bandwidth availability that impacts display resolution allows reduced overdrive voltages that scale to visual content resolution.

18 Claims, 4 Drawing Sheets

INFORMATION HANDLING SYSTEM DISPLAY INTELLIGENT CONTROL RESPONSE TIME

BACKGROUND OF THE INVENTION

Field of the Invention

The present invention relates in general to the information handling system visual presentation, and more particularly to an information handling system display intelligent control response time.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems process information to generate visual images as output for presentation to end users through displays. A typical display presents visual information by sweeping pixel values through an array of pixels that generate light based upon the pixel values. For example, a timing controller receives pixel values from a graphics controller through a serial interface, such as a DisplayPon cable, and scans the pixel values through rows and columns of pixels at a scan rate. Visual images present at the display from the aggregate of the pixels illuminated with colors defined by the graphics controller. The scan rate provides a rapid enough change of the pixel values that the human eye captures the aggregate image without seeing changes at a pixel or scan level.

Liquid crystal displays (LCDs) present information by varying a liquid crystal state to adjust the amount of light that passes through a pixel from a backlight. An electric field is generated at each pixel to control the liquid crystal state and thus manage the light that passes through at the pixel. Colors for a pixel are managed by passing through different amounts of red, green and blue light from the backlight. Generally, the liquid crystal state is managed by applying an electrical current to the liquid crystal material so that an electric field moves the liquid crystal material into a crystal state. The liquid crystal material has a viscous nature that responds to the electric field over time. Slow response rate of liquid crystal material can impact the presentation of visual images, especially where visual images change rapidly across the display. For example, ghosting occurs when the response time of the liquid crystal is too slow to keep up with the display refresh rate.

One technique to improve liquid crystal response time is to overcharge the electric field of the pixel to force the liquid crystal to orient in a more rapid manner, then remove the overcharge to allow the liquid crystal to return to its original position. The amount of overcharge impacts how quickly the liquid crystal switches between desired orientations. An overcharge applied to the liquid crystal provides a more rapid response that reduces ghosting effects in rapidly moving images, however, the overcharge current tends to increase power consumption. In U.S. Pat. No. 7,428,647 by Price et al., battery life for a portable information handling system was managed by setting overdrive on when external power was available and off when battery power was used to run the system. LCD timing controllers selectively apply the overdrive based upon a register setting. If overdrive is applied to a display that has a static or slowly moving image, the end user will not typically see an impact from the selection of overdrive, however, power consumed by the display will increase proportionally with the overdrive applied.

SUMMARY OF THE INVENTION

Therefore, a need has arisen for a system and method which manages display panel overdrive to adapt to an information handling system operating environment.

In accordance with the present invention, a system and method are provided which substantially reduce the disadvantages and problems associated with previous methods and systems for managing display panel overdrive. End user settings configure a display to apply overdrive to pixels based on sensed conditions related to display resolution and image movement. Pixel overdrive reverts to reduced levels, just as normal pixel voltage drive levels, as display image conditions change, thus reducing power consumption for sensed conditions that do not have increased image movement.

More specifically, an information handling system processes information with a processor and memory to present visual images through at a display, such as a liquid crystal display. End user settings adapt display responsiveness by adjusting pixel voltage overdrive to provide more rapid liquid crystal state changes when visual information has increased movement. An overdrive manager executing on a processing component of the display or information handling system adapts overdrive settings to enviromnent changes sensed at the information handling system so that power consumption related to overdrive use is reduced as conditions warrant. For example, sensed conditions that indicate reduced end user experience impact from overdrive use trigger adjustments to lower overdrive settings and/or reversion to normal voltage drive settings. For instance, available network bandwidth that indicates reduced network-based visual image resolution triggers lower overdrive voltage settings so that power consumption is reduced while overdrive voltage provides minimal if any improvement to the end user visual experience. Other environmental factors power state, wireless networking state, media state, user environment state and ambient light state. The overdrive manager applies sensed conditions and user preferences to manage power consumption with an optimized end user visual experience.

The present invention provides a number of important technical advantages. One example of an important technical advantage is that an information handling system display adapts pixel drive voltage to manage power consumption as image quality and external conditions change. For example, a user configures the display to apply overdrive voltage to pixels for desired conditions, such as playing a game that involves rapidly moving images across a display. Overdrive is selectively tuned to higher and lower levels as needed to optimize the user's experience viewing the display. As conditions are sensed that impact visual information quality, such as reduced network connectivity, overdrive is reduced or reverted to normal levels so that power consumption is decreased where visual image quality is not enhanced by increased overdrive settings. Similarly, if a user leaves the proximity of the display or changes ambient lighting so that display parameters have less impact, overdrive voltages may be reduced or reverted until the end user returns to a viewing condition that is impacted by overdrive.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Dynamic adjustment of display overdrive voltage presents information handling system visual images with balanced resolution and power consumption. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
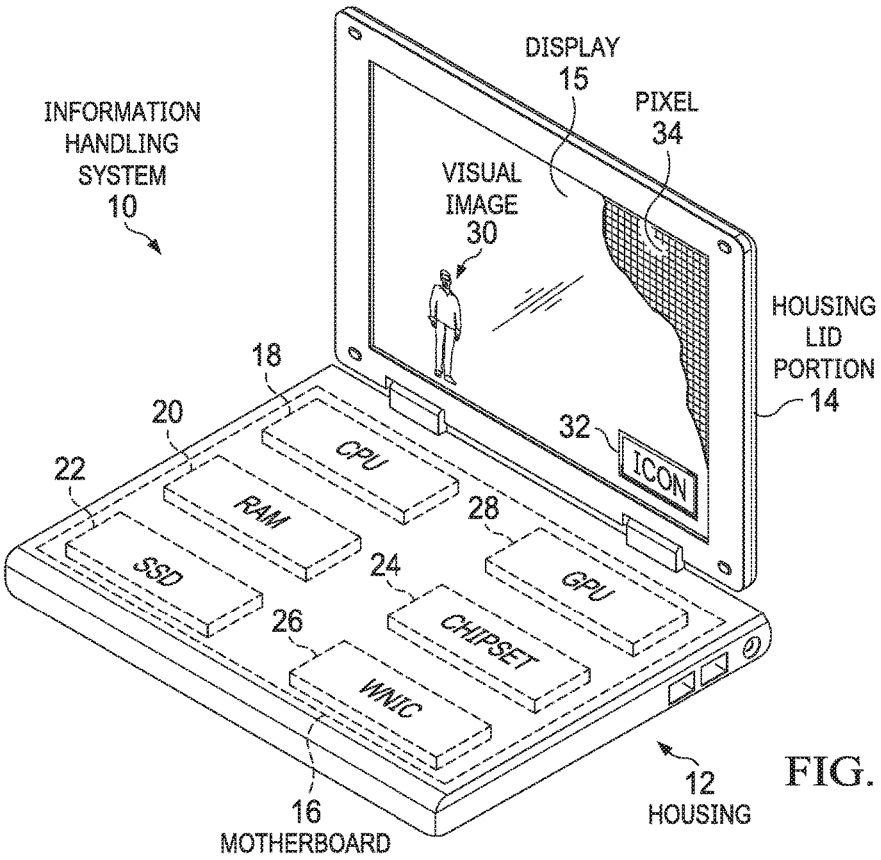
FIG. 1 depicts an example embodiment of a portable information handling system having pixel overdrive voltage management.

Referring now to FIG. 1, an example embodiment of a portable information handling system 10 having pixel overdrive voltage management is depicted. Information handling system 10 has a portable housing 12 with a rotationally-coupled lid portion 14 having an integrated display 15. Housing 12 contains a motherboard 16 that establishes communication between various processing components that cooperate to process information. In the example embodiment, a central processing unit (CPU) 18 processes information by executing instructions, such as for an operating system and applications that generate visual information for presentation to an end user through display 15. Random access memory (RAM) 20 stores the information and instructions in cooperation with CPU 18. A solid state drive (SSD) 22 or other persistent storage device stores the operating system and application during system power down. A chipset 24 includes a variety of processing components and flash memory that store firmware to coordinate interactions between CPU 18 and other devices, such as input/output devices and peripherals. For example, chipset 24 coordinates network communications through a wireless network interface card (WNIC) 26, such as wireless local area network (WLAN) communications. Similarly chipset 24 coordinates wireless communications through WNIC 26 with wireless peripherals, such as a wireless keyboard and mouse. Chipset 24 also coordinates presentation of visual information at display 15 through a graphics processor 28. For instance, graphics processor 28 receives visual information generated by CPU 18 and processes the visual information to generate pixel values that define a visual image 30. Visual information may be created with instructions executing on CPU 18, retrieved from memory or retrieved through a network interface using WNIC 26.

In the example embodiment, display 15 is a liquid crystal display having an array of plural pixels 34 and creates images 30 by adjusting the light that passes through the pixels 34. For example, a timing controller (TCON) 32 scans through pixels 34 at a rapid rate to apply pixel values communicated from GPU 28 that define images 30. TCON 32 scans through pixels 34 at a rapid enough rate that changes to pixels 34 are not detectable by the human eye. As pixels 34 change values, liquid crystals in each pixel 34 adjust the amount red, green and blue light that pass through to create a defined color. Generally, color values at a pixel change gradually with visual images that have minimal movement, such as user interfaces that support word processing or similar applications. When visual images have greater amounts of movement, such as with movies and gaming applications, pixel color values can change quite rapidly and significantly. Scan rates have a practical limitation in that liquid pixels have some time lag responding to changes in value so that pixels can ghost or otherwise show inaccurate color values that degrade visual images 30. The example embodiment depicts an integrated liquid crystal display 15, however in alternative embodiments peripheral displays may be used. Similarly, head mounted displays that place the visual image at a lens proximate the user may be used. For example, a typical head mounted display may include an integrated liquid crystal display panel illuminated by projected light at a goggle face in front of the user's eyes. Head mounted displays are often used for gaming applications that have rapid movement of visual images communicated through a network, such as the Internet. To provide responsive image presentation with high resolution moving content, increased voltage is used to drive pixel liquid crystal state changes in a more rapid manner. However, overdrive voltage tends to increase power consumption by the display and provides little if any use experience enhancements for presentation of non-moving and/or lower resolution images.

Figure 2:
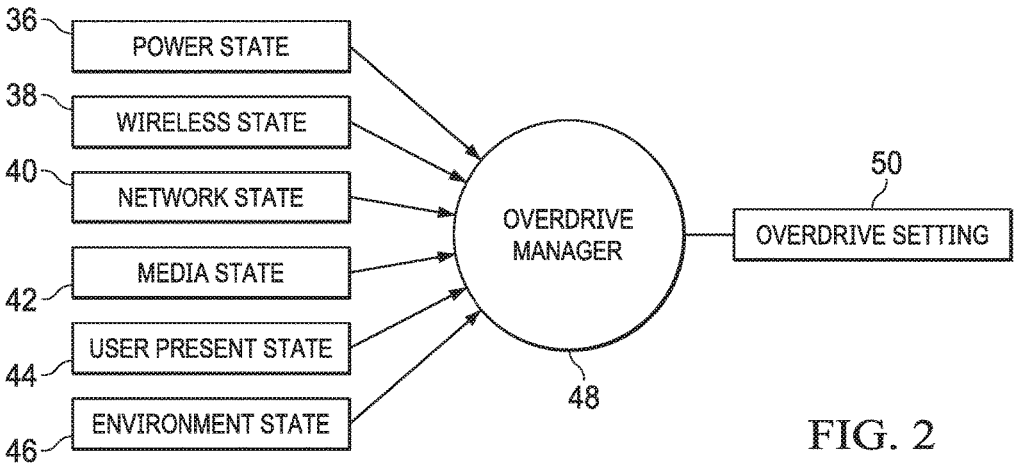
FIG. 2 depicts a state diagram of an overdrive manager that manages overdrive settings at a display based upon content, user preferences and sensed environmental conditions.

Referring now to FIG. 2, a state diagram depicts an overdrive manager 48 that manages overdrive settings at a display based upon content, user preferences and sensed environmental conditions. Overdrive settings 50 are initiated as default settings or user selections and then changed as content and environmental conditions change. For example, a user who primarily uses an information handling system to play games may set overdrive voltage settings to a maximum value that gives the greatest available display motion resolution. Other users who use an information handling system for word processing or similar static display tasks may set pixel voltage drive to a minimal value that does not overdrive voltages at all. Once initial settings are enforced, overdrive manager 48 adapts the amount of overdrive voltage to changing conditions. In various embodiments, overdrive manager 48 is software or firmware that executes on one more processing components of an information handling system, such as CPU 18, chipset 24, GPU 28 and/or TCON 32.

A power state sensor 36 provides power state information to overdrive manager 48 as one factor applied to establish an overdrive voltage setting. For example, on external power, a full range of overdrive voltages is permitted with the maximum relevant setting selected. On battery power, a more limited range of overdrive voltages are allowed with maximum settings restricted so that battery consumption is reduced yet improved visual performance remains available. As battery charge falls, overdrive voltages may be further restricted or fully reverted to nominal voltage drive settings. Over drive manager 48 dynamically adapts overdrive voltage settings 50 as power conditions change, such as by monitoring external power and battery charge states tracked by chipset 24.

A wireless state sensor 38 provides wireless communication state information to overdrive manager 48 as another factor applied to establish an overdrive voltage setting. For example, display 15 sometimes receives pixel information through a wireless display interface that has a limited range and can suffer from bandwidth congestion. In the event that wireless communication conditions deteriorate in a manner that impacts the scan rate or resolution of images 30 presented at display 15, overdrive voltage settings may be reduced to match the available display performance without expending extra power that fails to enhance the viewing experience.

A network state sensor 38 provides network communication state information to overdrive manger 48 as another factor applied to establish an overdrive voltage setting. For example, visual information generated at a display often originates from network locations, especially with movies and games. Available bandwidth impacts data transfer so that the quality and update rate of pixel values sometimes depends upon retrieval of data through a network interface. Network state sensor 40 monitors available bandwidth to adjust overdrive voltage settings downward when visual information transfer rates decrease due to decreases in available bandwidth. In one embodiment, if a network connection is lost the system reverts to nominal pixel drive voltage, such as without any overdrive voltage. Media state sensor 42 adjusts overdrive voltage in a similar manner based upon the nature of visual media presented at a display. If visual media lacks a quality that benefits from overdrive voltage, such as due to poor resolution or low update rates, pixel overdrive voltages are adjusted to an appropriate level or to a nominal level.

A user present state sensor 44 provides detection of a user proximate the display to selectively adapt the display pixel overdrive voltage. For example, a camera scans for a user, or detects the user's eye direction, to determine when a user is not viewing the display. When a user is not viewing display content, voltage overdrive values may be set to a nominal non-overdrive value and then rapidly reset to an overdrive value when the user shifts his gaze back to the display. Environment state sensor 46 monitors other environmental factors to determine if overdrive voltages should be increased or reduced. For example, an ambient light sensor detects ambient light levels proximate the display and adjusts overdrive voltages as ambient light levels change. For instance, an increase in brightness decreases the visual acuity for viewing a display and thus reduces the need for response pixel changes driven by an overvoltage.

Figure 3:
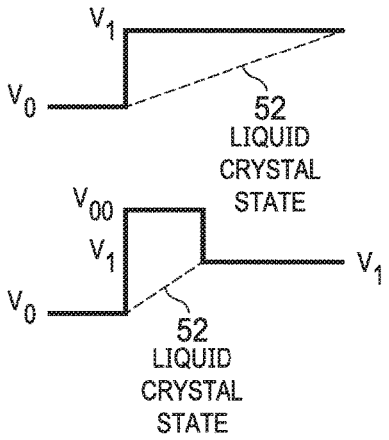
FIG. 3 depicts examples of normal and overdrive voltage applied to change a liquid crystal state.

Referring now to FIG. 3, examples are depicted of normal and overdrive voltage applied to change a liquid crystal state. A change in current applied at a voltage increase from V0 to V1 provides a more gradual change in liquid crystal state 52 over time compared with a change in voltage from V0 past V1 to V00. The more gradual change in liquid crystal state produces a shift in color over time that is more graduated relative to when an overdrive voltage is applied. However, the overdrive voltage does increase power consumption at the display. The present invention adapts to plural levels of overdrive voltage so that pixel responsiveness may be increased to several levels depending upon enviromnental conditions. For example, high resolution visual information has the highest overdrive voltage setting, a moderate resolution visual image has a middle-range overdrive voltage, and low quality visual information has nominal voltage drive settings without overdrive. Further, in one embodiment, overdrive voltage is controlled on a pixel-by-pixel basis by having the graphics processor include an overdrive voltage setting with each pixel values as the pixel value is sent to the display. For example, the graphics controller may send an overdrive voltage setting with pixels of a movie shown in a window on part of a display while assigning a nominal overdrive voltage to other portions of the display.

Figure 4:
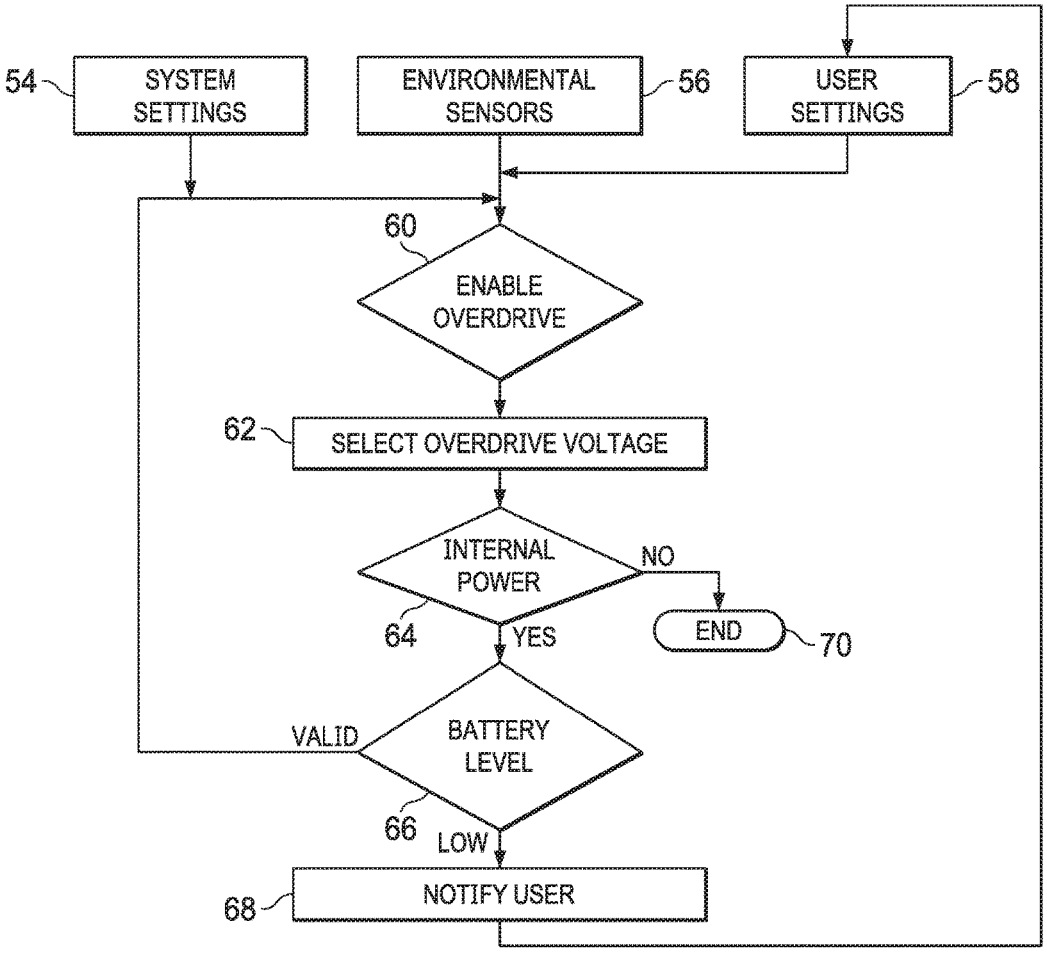
FIG. 4 depicts a flow diagram of a process for adapting overdrive voltage to environmental conditions.

Referring now to FIG. 4, a flow diagram depicts a process for adapting overdrive voltage to environmental conditions. Systems settings 54, environmental sensor readings 56 and user settings 58 provide an initial configuration for the overdrive voltage applied at a display. At step 60, a determination is made of whether to enable overdrive voltage and the appropriate level of overdrive voltage to apply. For example, a user setting to enable full overdrive voltage may be reduced to a partial overdrive voltage based upon ambient light conditions and an enterprise setting. At step 62 the overdrive voltage is selected and set. At step 64 a determination is made of whether the system is running on internal power. If not, in the example embodiment, the process ends at step 70 with overdrive voltage enabled. If the system is running on internal power, the process continues to step 66 to monitor battery charge level. If the battery charge level is adequate, the process returns to re-evaluate the system settings, environmental sensors and user settings. If at step 66 battery is low, the process continues to step 68 to notify the user that overdrive voltage should be disabled. The process then continues to step 58 to accept end user settings for the overdrive voltage.

Figure 5A:
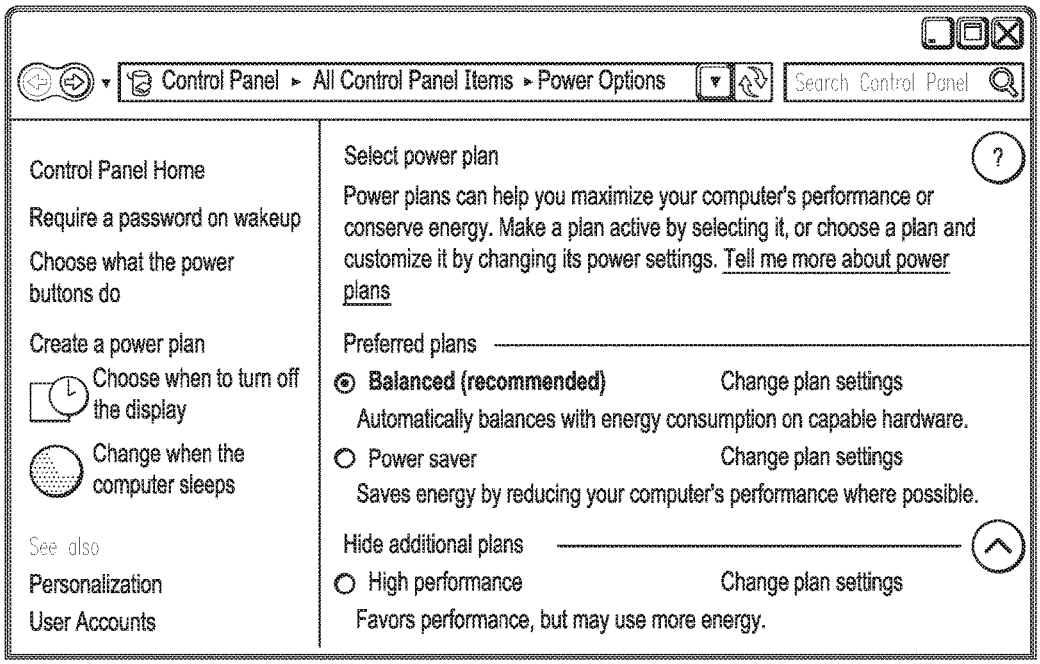
FIGS. 5A through 5D depict examples of user interfaces to select overdrive voltage settings.
Figure 5B:
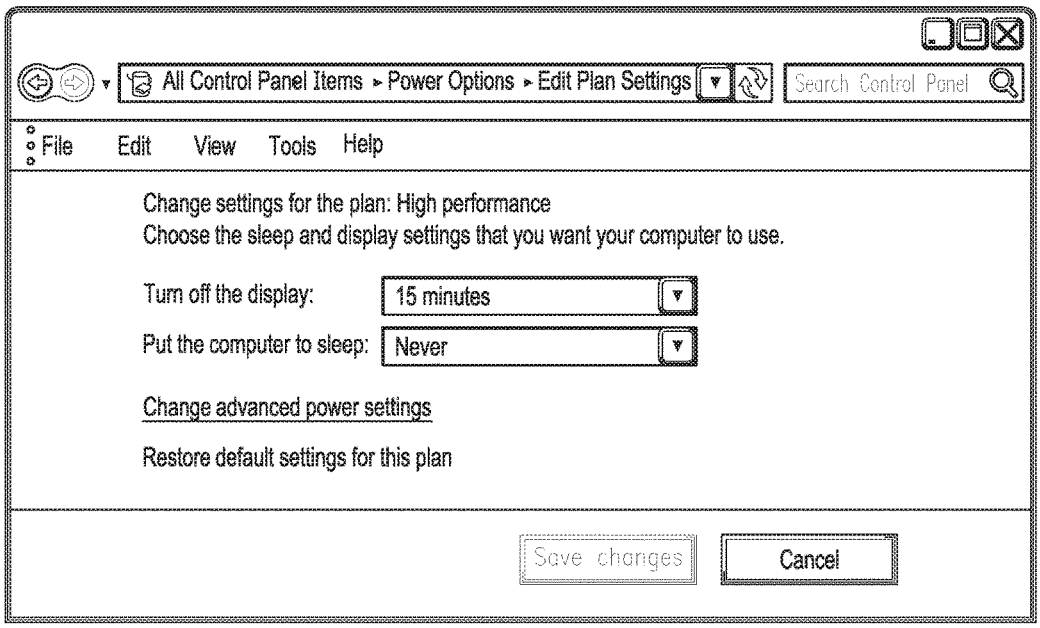
Figure 5C:
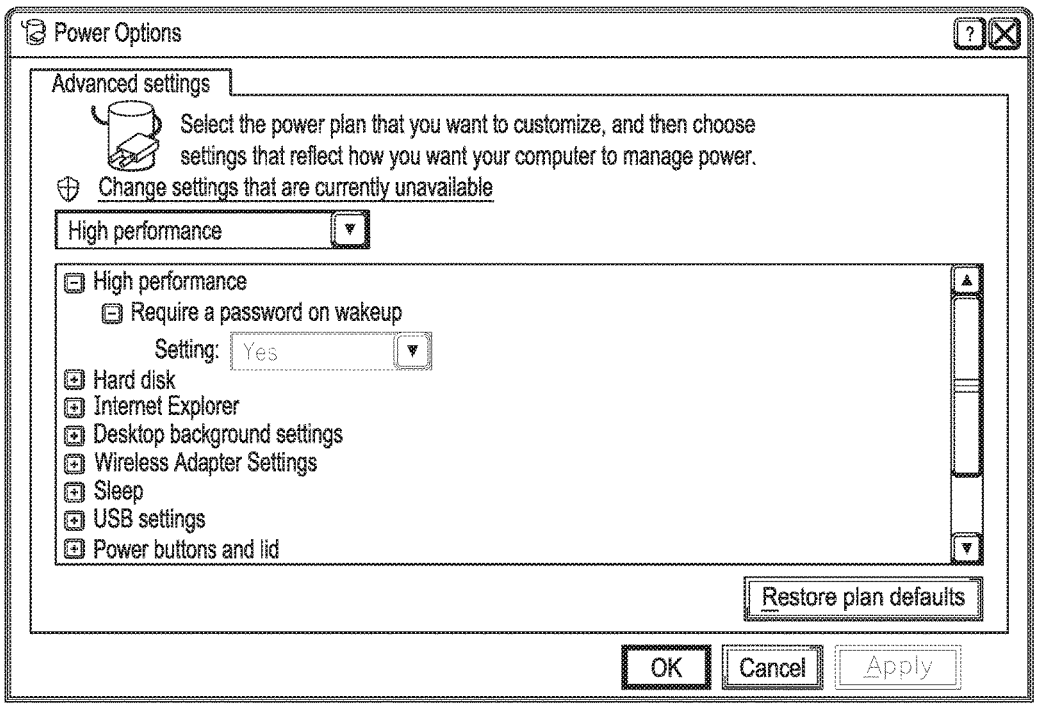
Figure 5D:
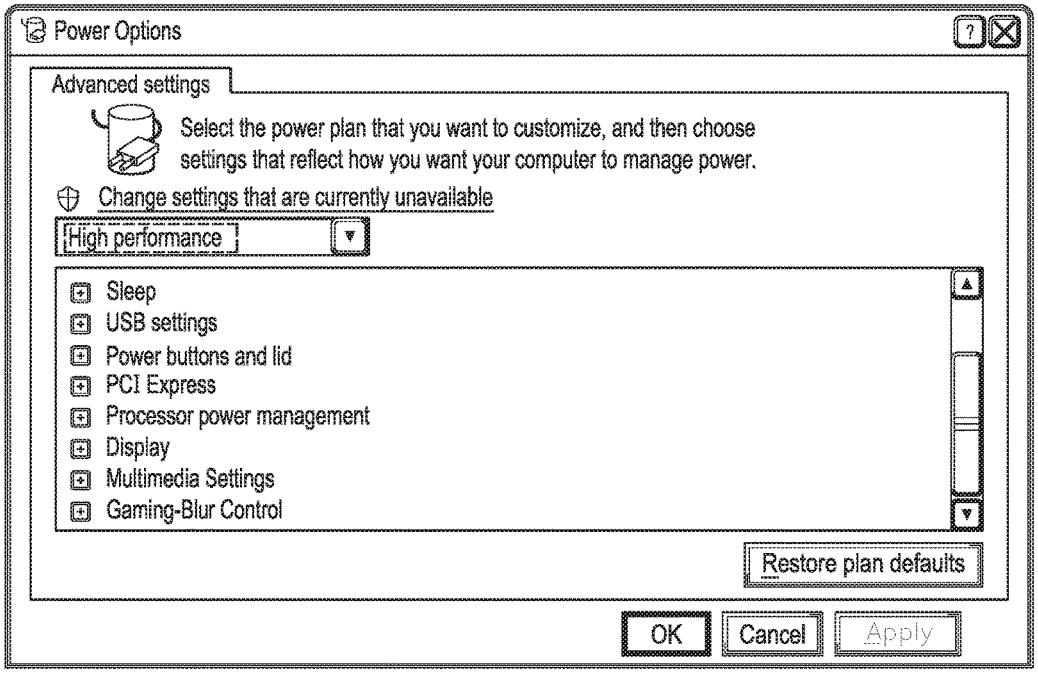

Referring now to FIG. 5A through 5D depict examples of user interfaces to select overdrive voltage settings. In the example embodiments, an end user engages with an operating system power management system to define overdrive voltage settings. For example, the user selects a control panel in FIG. 5A and edits power settings in FIG. 5B. The user selects changes to advanced power settings and in FIG. 5C selects to define a high performance power plan. In FIG. 5D, the user selects game blur control to define the use enhanced overdrive voltage settings. Once saved, the settings are applied and then modified based upon sensed conditions as described above.

Although the present invention has been described in detail, it should be understood that various changes, substitutions and alterations can be made hereto without departing from the spirit and scope of the invention as defined by the appended claims.

What is claimed is:

1. An information handling system comprising:

a processor operable to execute instructions to generate visual information;

a memory operable to store the instructions and visual information;

a graphics processor interfaced with the processor and memory, the graphics processor operable to generate pixel values from the visual information and to communicate the pixel values to a display to present a visual image defined by the visual information;

a display interfaced with the graphics processor, the display having plural pixels, each pixel adapted by application of current at a drive voltage to control illumination of color, the color defined by the pixel value;

a display controller integrated with the display and interfaced with the graphics controller, the display controller operable to selectively apply current at one or more overdrive voltages, the overdrive voltage defining a transition time of a pixel from illumination of a first color to illumination of a second color;

an overdrive manager interfaced with the display controller and operable to configure the overdrive voltage based upon an end user overdrive setting and at least one external factor detected by a sensor interfaced with the overdrive manager; and a network interface card operable to establish communication with a network external to the information handling system;

wherein the external factor comprises available bandwidth detected by the network interface card.

2. The information handling system of claim 1 wherein the available bandwidth is associated with visual information communicated through the network for presentation at the display.

3. The information handling system of claim 2 wherein the overdrive manager applies the drive voltage up to a first available bandwidth, a first overdrive voltage up to a second available bandwidth, and a second overdrive voltage up to a third available bandwidth.

4. The information handling system of claim 3 wherein the overdrive manager reverts to the drive voltage at detection of a loss of the network communication.

5. The information handling system of claim 1 wherein the overdrive manager configures a first overdrive voltage for a first available bandwidth and reverts to the drive voltage at the first available bandwidth upon detection of a predetermined battery charge.

6. The information handling system of claim 1 wherein the display comprises a liquid crystal display.

7. The information handling system of claim 1 further comprising:

an ambient light sensor interfaced with the overdrive manager and operable to detect ambient light proximate the display;

wherein the external factor comprises ambient light sensed proximate the display.

8. An information handling system comprising:

a processor operable to execute instructions to generate visual information;

a memory operable to store the instructions and visual information;

a graphics processor interfaced with the processor and memory, the graphics processor operable to generate pixel values from the visual information and to communicate the pixel values to a display to present a visual image defined by the visual information;

a display interfaced with the graphics processor, the display having plural pixels, each pixel adapted by application of current at a drive voltage to control illumination of color, the color defined by the pixel value;

a display controller integrated with the display and interfaced with the graphics controller, the display controller operable to selectively apply current at one or more overdrive voltages, the overdrive voltage defining a transition time of a pixel from illumination of a first color to illumination of a second color; and an overdrive manager interfaced with the display controller and operable to configure the overdrive voltage based upon an end user overdrive setting and at least one external factor detected by a sensor interfaced with the overdrive manager;

a user-present detector interfaced with the overdrive manager and operable to detect proximity of a user to the display;

wherein the overdrive manager reverts from any overdrive voltage to the drive voltage if a user is not proximate the display.

9. A method for presenting visual images at an information handling system display, the method comprising:

storing in non-transitory memory a user-selected overdrive voltage setting;

detecting a predetermined condition external to the information handling system with one or more sensors;

automatically applying the overdrive voltage setting and the predetermined condition to present visual images with pixels of a display with a selected of an overdrive voltage or a drive voltage applied to the pixels; and communicating with a network to retrieve visual information for presentation at the display;

wherein the predetermined condition comprises bandwidth available on the network to communicate the visual information.

10. The method of claim 9 further comprising:

applying a first overdrive voltage if available bandwidth exceeds a predetermined amount; and applying the drive voltage if available bandwidth falls below a predetermined threshold.

11. The method of claim 9 further comprising:

detecting loss of a connection with the network; and in response to the detecting, reverting to the drive voltage from the overdrive voltage.

12. The method of claim 9 further comprising:

detecting ambient light at the display; and applying the amount of ambient light as the predetermined condition.

13. The method of claim 9 further comprising plural overdrive voltage settings, each overdrive voltage setting selected if an associated predetermined condition is detected.

14. A method for presenting visual images at an information handling system display, the method comprising:

storing in non-transitory memory a user-selected overdrive voltage setting;

detecting a predetermined condition external to the information handling system with one or more sensors; and automatically applying the overdrive voltage setting and the predetermined condition to present visual images with pixels of a display with a selected of an overdrive voltage or a drive voltage applied to the pixels;

presenting the visual images with a liquid crystal display integrated in a headset; and the predetermined condition comprises detecting the headset worn by an end user.

15. A display comprising:

plural pixels, each pixel accepting one or more currents to set a color, each current sent at a voltage;

a timing controller interfaced with the pixels and operable to set a color for each pixel; and a graphics controller interfaced with the timing controller, the graphics controller providing the timing controller with selected of a drive voltage and an overdrive voltage to apply to the pixels, the overdrive voltage setting the color based at least in part on available bandwidth of a network connection.

16. The display of claim 15 wherein the graphics controller defines an overdrive voltage individually for each pixel, the timing controller applying the overdrive voltage for each pixel.

17. The display of claim 15 further comprising:

a sensor operable to detect proximity of an end user to the display;

wherein the graphics controller disables the overdrive voltage when a user is not detected proximate the display.

18. The display of claim 15 further comprising an ambient light sensor interfaced with the graphics controller, the graphics controller disabling the overdrive voltage at a predetermined ambient light.

* * * * *